US006932239B2

(12) United States Patent
McKitrick

(10) Patent No.: US 6,932,239 B2
(45) Date of Patent: Aug. 23, 2005

(54) PROTECTIVE MASK DRINKING TUBE COUPLING DEVICE AND METHOD OF USE

(76) Inventor: Robert McKitrick, 152 Wunnegin Cir., East Greenwich, RI (US) 02818

( * ) Notice: Subject to any disclaimer, the term of this patent is extended or adjusted under 35 U.S.C. 154(b) by 78 days.

(21) Appl. No.: 10/364,296

(22) Filed: Feb. 11, 2003

(65) Prior Publication Data

US 2004/0155054 A1 Aug. 12, 2004

(51) Int. Cl.[7] ..... B67D 5/00

(52) U.S. Cl. ..... 222/83; 222/91; 220/705; 220/714; 215/388

(58) Field of Search ..... 222/80–83, 86, 222/91, 175, 207, 464.1; 128/202.15, 202.16, 206.29; 220/705, 709, 714, 717, 707; 215/388, 11.4; 239/33

(56) References Cited

U.S. PATENT DOCUMENTS

| | | | | | |
|---|---|---|---|---|---|
| 1,618,720 | A | * | 2/1927 | Moore | 222/91 |
| 1,645,127 | A | | 10/1927 | Carnes | |
| 3,278,083 | A | * | 10/1966 | Serafini | 222/91 |
| 3,731,717 | A | | 5/1973 | Potash | 141/379 |
| 3,768,698 | A | * | 10/1973 | Corty et al. | 222/91 |
| 3,973,698 | A | * | 8/1976 | Kato | 222/91 |
| 4,398,533 | A | * | 8/1983 | Barker | 128/202.15 |
| 4,505,310 | A | | 3/1985 | Schneider | 141/114 |
| 4,712,594 | A | | 12/1987 | Schneider | 141/114 |
| 4,826,500 | A | | 5/1989 | Rautsola | 604/411 |
| 4,875,508 | A | | 10/1989 | Burke, II et al. | 141/2 |
| 4,881,662 | A | * | 11/1989 | Tallman | 222/81 |
| 4,971,048 | A | | 11/1990 | Seekins | 128/202.15 |
| 5,090,596 | A | | 2/1992 | Knight | 222/91 |
| 5,146,757 | A | | 9/1992 | Dearing | 62/61 |
| 5,328,059 | A | | 7/1994 | Campbell | 222/189 |
| 5,609,582 | A | | 3/1997 | Krutten | 604/247 |
| 5,971,207 | A | | 10/1999 | McDonough et al. | 222/1 |
| 6,202,717 | B1 | | 3/2001 | Markey et al. | 141/383 |
| 6,325,116 | B1 | | 12/2001 | Savage et al. | 141/349 |
| 2002/0092858 | A1 | | 7/2002 | Bowman | 220/709 |
| 2002/0121525 | A1 | | 9/2002 | Stillinger et al. | 220/705 |

OTHER PUBLICATIONS

"Protect Yourself From NBC Injury/Contamination When Drinking From Your Canteen While Wearing Your Protective Mask," Soldier's Manual of Common Tasks, Skill Level 1, Soldier Training Publication No. 21–2– SMCT, Department of the Army, Washington, DC, pages i and 320–331, 1994.

* cited by examiner

*Primary Examiner*—Frederick Nicolas
(74) *Attorney, Agent, or Firm*—McCarter & English, LLP

(57) ABSTRACT

A coupling device is provided for allowing one wearing a protective mask to drink fluids from a standard drinking fluid container. The device includes a punch at one end, a central body, and a capture port at the other end of the central body. The punch punctures a wall of a fluid container. Drinking fluid flows into the central body. The drinking tube is inserted into the port to allow one to drink fluid from the container. The device allows one wearing a protective suit in a contaminated environment to obtain drinking fluid from a standard, commercially-available container.

6 Claims, 9 Drawing Sheets

PROTECTIVE MASK DRINKING TUBE COUPLING DEVICE AND METHOD OF USE

BACKGROUND OF THE INVENTION

1. Field of the Invention

The present invention relates to a coupling device for connecting a drinking tube of a protective mask with a standard, commercially-available drinking fluid container.

2. Related Art

Protective suits worn by individuals in hazardous or contaminated environments often include head coverings with protective masks. Governments, militaries, and private industries have developed such protective masks and suits in an attempt to allow personnel to function in areas where there may be nuclear, biological, or chemical contamination. These protective masks and suits are hot to wear. As a result, major problems for the wearers of such protective masks and suits include rapid and potentially life-threatening dehydration and associated elevated core body temperature, which necessitate frequent fluid intake.

Many masks, such as the "M" series protective type, have drinking tubes that allow the mask wearer to access and drink from compatible "canteen" fluid sources. However, the canteen sources have a limited volume, and are very difficult to safely refill in a contaminated area. In order to obtain additional fluids, individuals are forced to leave the contaminated site, decontaminate themselves, and drink hydrating fluids from non-contaminated sources. From a military standpoint, as well as a Post-9/11 First Responder perspective, this is not only dangerous, but also impractical. Today's operating environment may require military forces, allies, first responders, and critical infrastructure managers to remain "in place" for extended periods of time, even days, to accomplish their assigned tasks.

Thus, there is a need for a system of connecting the drinking tube of a protective mask with a commercially-available fluid container in a contaminated environment, such that both the mask wearer and the fluid in the container are maintained contaminant-free, and which also allows the uninterrupted functioning of personnel in the contaminated environment.

SUMMARY OF THE INVENTION

The present invention relates to a device for connecting a drinking tube extending from a protective mask to a standard, commercially-available drinking fluid container, such as a plastic water bottle, to enable the wearer of the mask to drink the fluid from the container without contaminating the wearer or the fluid.

The present invention provides a hand-operated coupling device which includes a central cylindrical body with a punch at one end for insertion into a fluid container, and a capture port at the other end for insertion of a drinking tube extending from a protective mask. The punch has a sharp tip at one end which punctures a wall of the fluid container. The coupling device can be secured to the container in a number of ways. For example, the punch could include a threaded portion which is rotated into the container, whereby the threads secure the punch to the wall of the container. Alternatively, the punch could include one or more annular ridges shaped to engage a wall of the container upon insertion of the punch thereinto. Another way to secure the coupling device to the container is with a spring-loaded arm extending along the punch which bears against the inner wall of the container after the punch is inserted into the container. A gasket could be included for engaging with the outer wall of the container to seal the connection between the coupling device and the container. The gasket could be provided adjacent the central body of the coupling device. Apertures in the wall of the punch allow fluid to enter the punch and flow to the central body. A central bore that may vary in diameter extends through the central body. A valve, positioned within the central body and seated in the port, controls fluid flow between the punch and the port. Insertion of the mask drinking tube into the port moves the valve from a closed position seated in the bottom of the port to an open position so that fluid can flow through the device and into the mask tube to allow an individual wearing the protective mask to drink from the drinking fluid container.

The present invention also provides a method for a wearer of a protective mask in a contaminated environment to access fluid from a standard fluid container. The method of the present invention comprises piercing a wall of the fluid container with a punch on the coupling device, securing the device to the wall of the fluid container, and inserting a male connector of a drinking tube into a port on the device. Insertion of the male connector into the port unseats the valve from a closed position to an open position, forming a flow path between the punch and the port through which the drinking fluid flows from the container to the drinking tube of the protective mask.

BRIEF DESCRIPTION OF THE FIGURES

Other important objects and features of the invention will be apparent from the following Detailed Description of the Invention taken in connection with the accompanying drawings in which.

DETAILED DESCRIPTION OF THE INVENTION

The present invention provides a drinking fluid delivery system comprising a coupling device suitable for connecting drinking tubes found on military-type protective masks (e.g., M-Series including M17A1 series masks and M40/42 series masks, as well as mask upgrades, such as Joint Service General Purpose Masks (JSGPM) found on NATO-standard government issue and industrial protective clothing and equipment, or other similar masks) to standard, commercially-available drinking fluid containers, such as plastic water bottles and the like. The coupling device includes a central body with a punch at one end and a port at the other end. The punch penetrates the wall of a fluid container and creates a contamination-resistant seal. The central body includes a valve assembly which is activated by inserting a mask drinking tube into the port. The coupling device of the present invention provides a safe and contamination-resistant means of connecting a drinking fluid container and a protective mask drinking tube in a contaminated environment.

Figure 1:
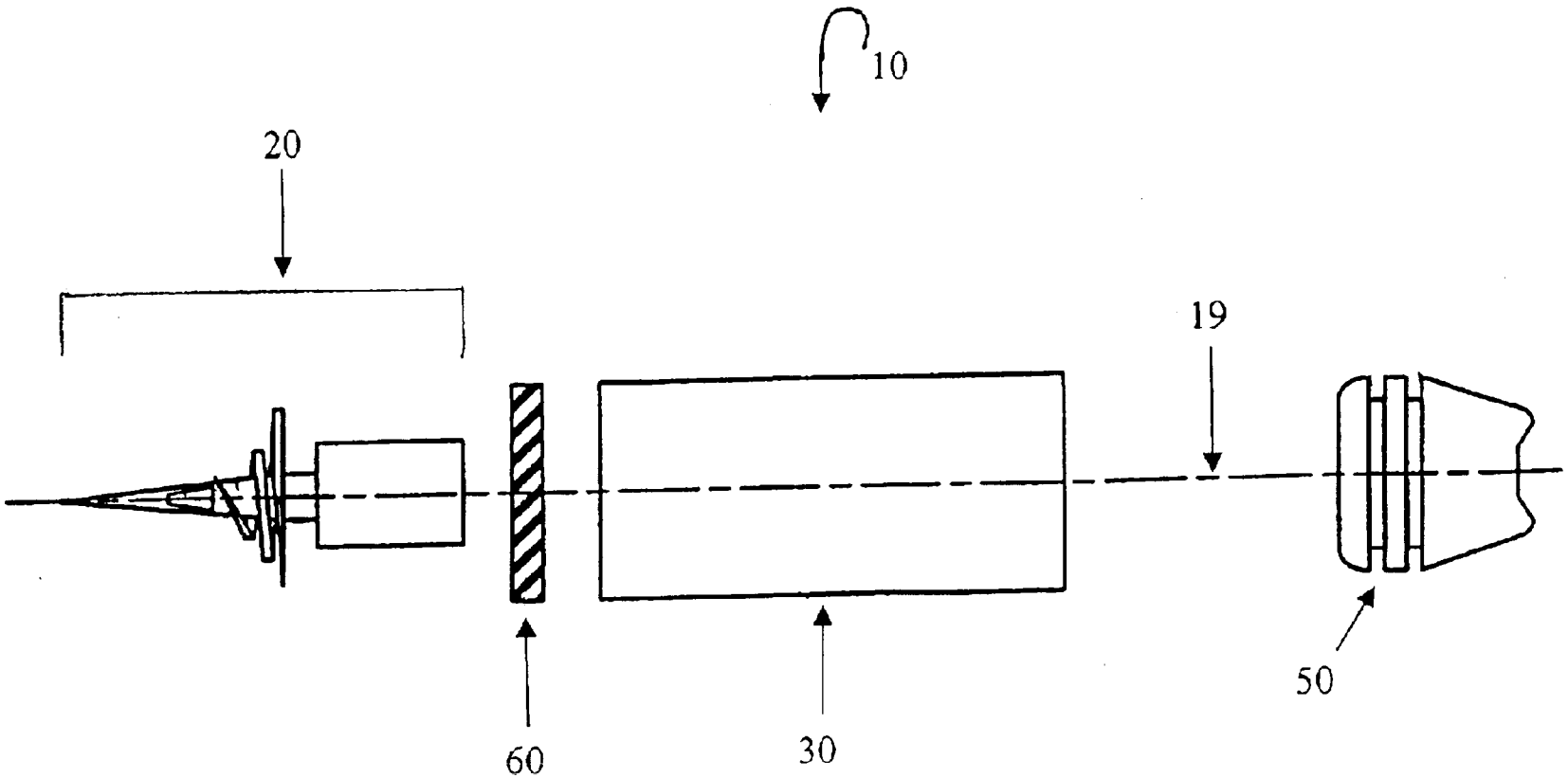
FIG. 1 is an exploded exterior side view of the main components of an embodiment of the device of the present invention.

The device of the invention is shown in FIGS. 1 through 11, wherein like numbers are used to designate like parts throughout the drawings. As shown in FIG. 1, the coupling device of the present invention is generally indicated at 10. The components of the coupling device, shown in exploded view, are centrally-oriented on a longitudinal axis as indicated by line 19. The coupling device includes a punch 20, central body 30, port 50 and gasket 60.

The punch 20 is made of rigid plastic, resin, or other suitable material strong enough for the tip of the punch to puncture or pierce a wall of a drinking fluid container using moderate manual force without damaging the integrity of punch 20. The punch 20 is connected to the body 30, and could be formed integrally therewith. Optionally, the gasket 60 could be provided, and is preferably disposed annularly about a cylindrical portion of the punch 20 and proximate to an end of the body 30, so as to seal the entire coupling device 10 against a side wall of a container. The port 50 preferably resides within an end of the body 30, and receives an end of a standard drinking tube. Preferably, the port 50 includes one or more ridges for engagement with and retention by the body 30.

Figure 2:
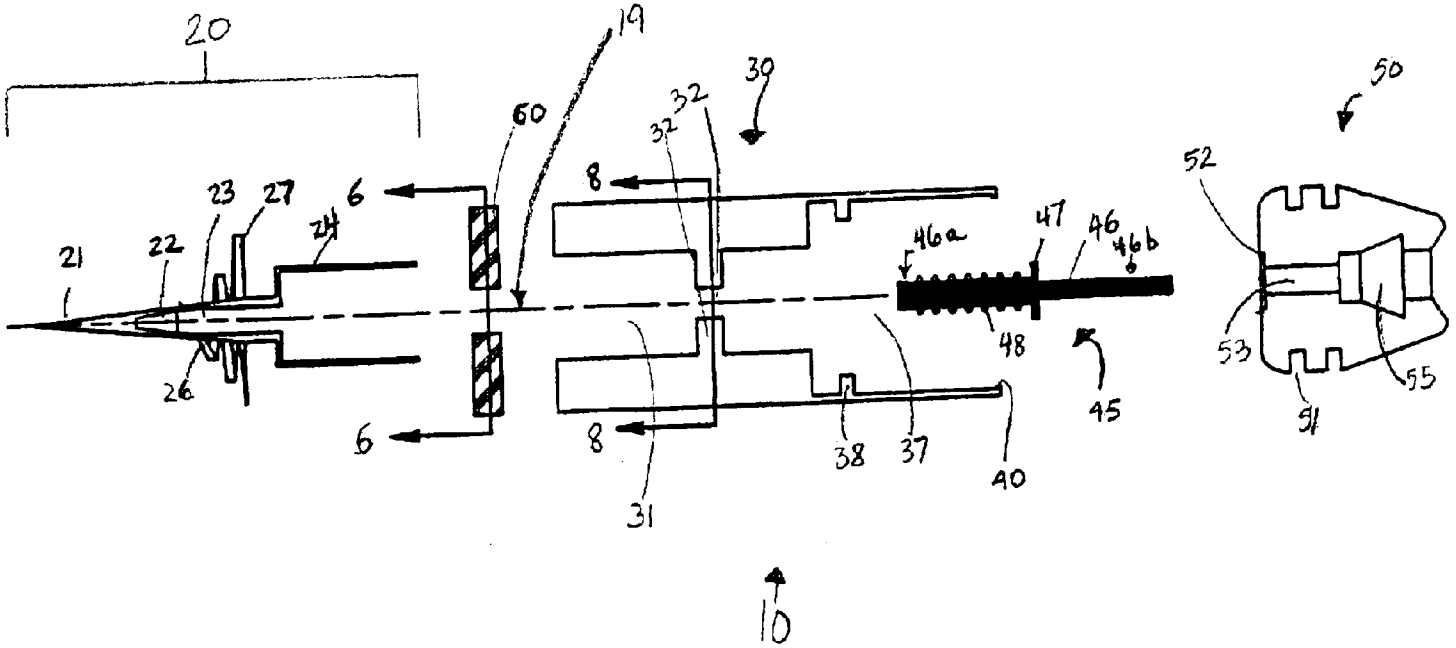
FIG. 2 is a cross-sectional exploded view of the device shown in FIG. 1.
Figure 3:
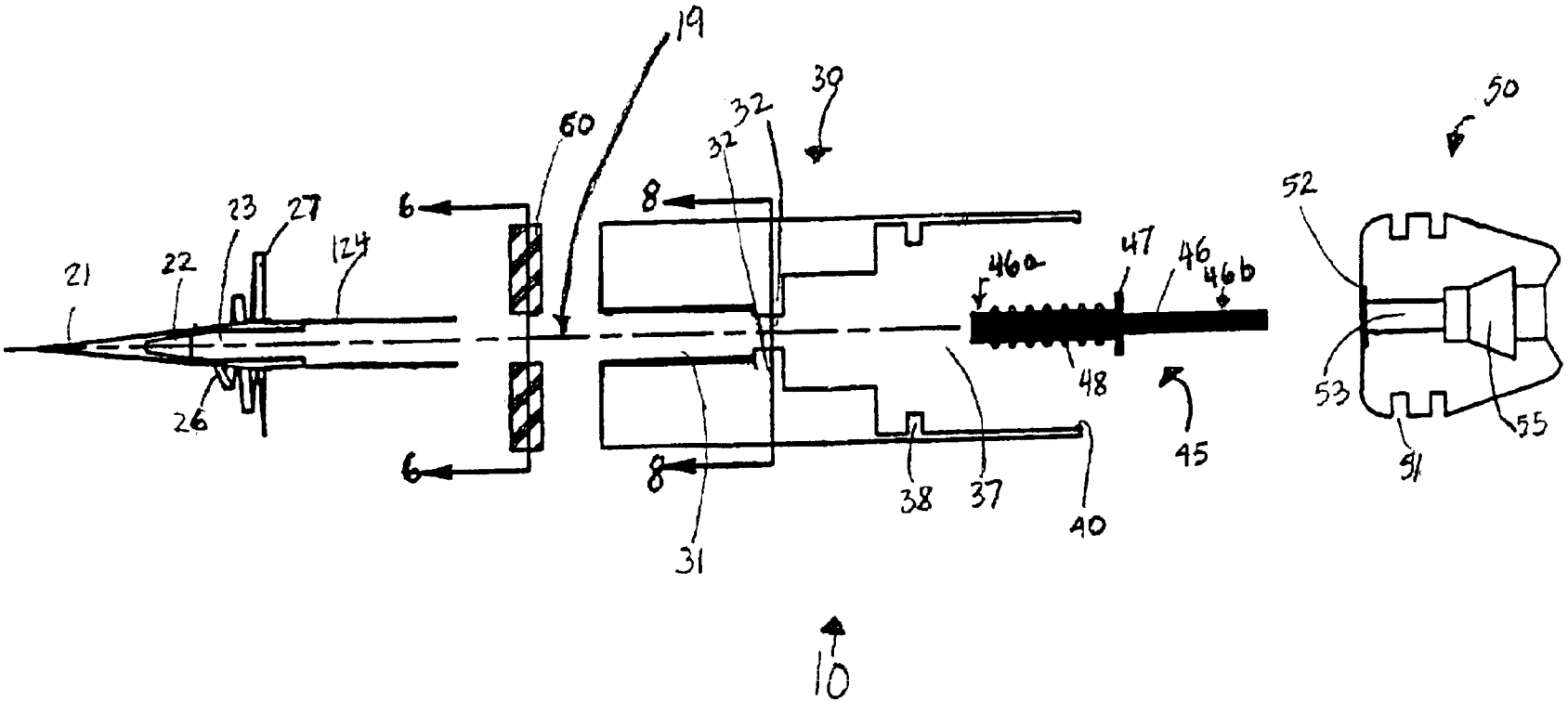
FIG. 3 is a cross-sectional exploded view of another embodiment of the device shown in FIG. 2 in which the shaft of the punch has a uniform diameter.

Referring to the embodiment of the invention shown in FIG. 2, the punch 20 has a tip 21, one or more apertures 22, a threaded shaft portion 23, and a cylindrical shaft portion 24. Threaded shaft portion 23 includes initial thread portion 26 which winds around to terminal thread portion 27. Terminal thread portion 27 is generally perpendicular to the longitudinal axis 19. The thread is of an increasing diameter as it advances away from the tip of the punch and along the threaded portion. Preferably, the thread has a sharp peripheral edge to facilitate catching and entering through the container wall. The punch 20 has one or more apertures 22 through which the fluid in the container flows into threaded shaft portion 23 and into cylindrical shaft portion 24. Cylindrical shaft portion 24 may be formed integrally with threaded shaft portion 23, or it could be formed separately and attached to threaded shaft portion 23 when the device is assembled. The diameter of cylindrical shaft portion 24 may vary. As shown in FIG. 3, the diameter of cylindrical shaft portion 124 is the same as the threaded shaft portion 23.

Figure 4:
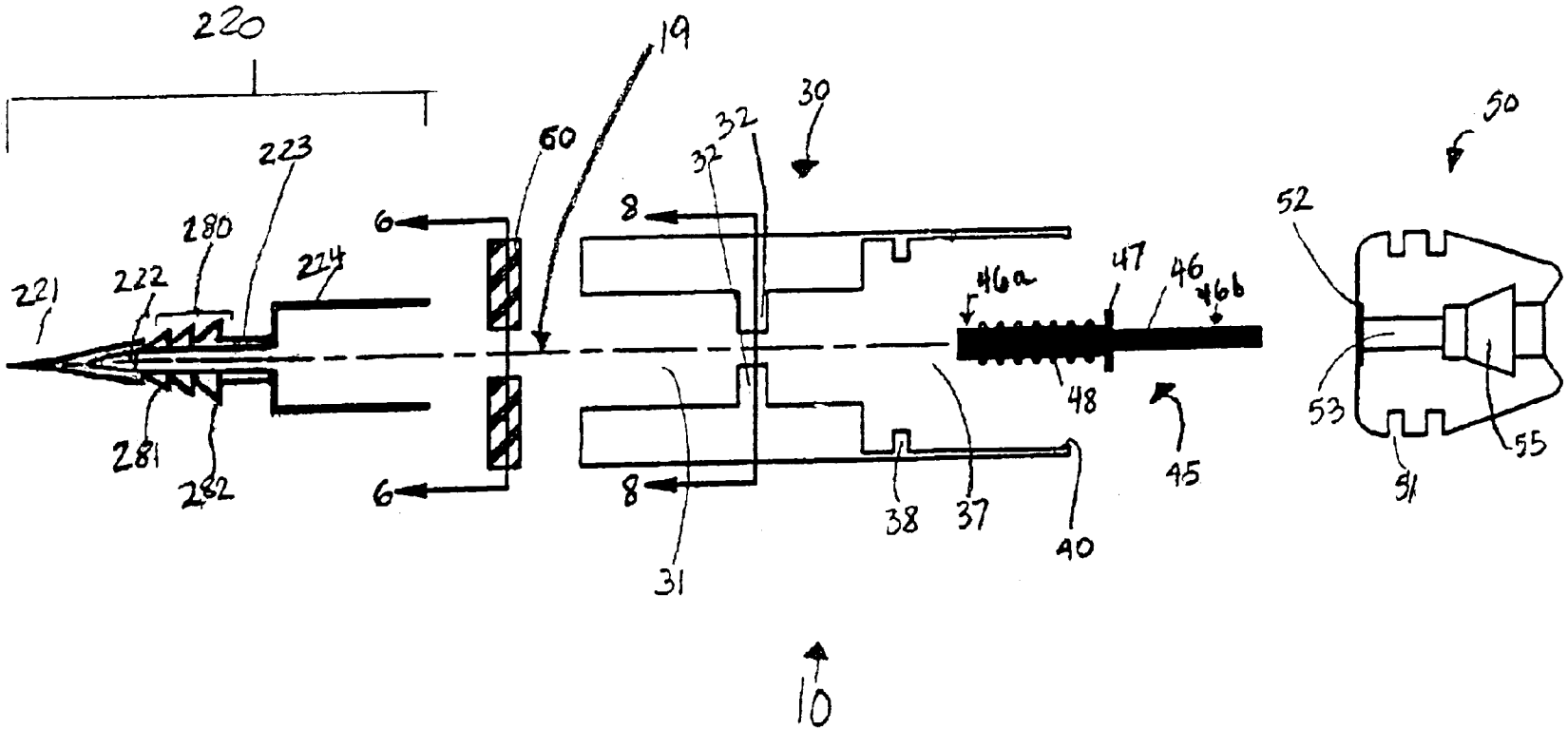
FIG. 4 is a cross-sectional exploded view of another embodiment of the device shown in FIG. 2 in which the punch has annular ridges.

FIG. 4 shows a punch configuration that does not include a thread. The punch 220 includes a tip 221, one or more apertures 222, a ridged shaft portion 223, and cylindrical shaft portion 224. Ridged shaft portion 223 has one or more annular ridges 280 along the length of shaft portion 223. Where more than one ridge is included, initial ridge 281 is positioned closest to the tip of the punch, and terminal ridge 282 is positioned farthest from the tip. Each ridge has a leading edge extending on an angle from the ridged shaft portion 223 to a peak, and a second trailing edge extending generally perpendicularly from the ridge back to the ridged shaft portion 223. The peaks of succeeding ridges extend further out from the ridged shaft portion.

Figure 5:
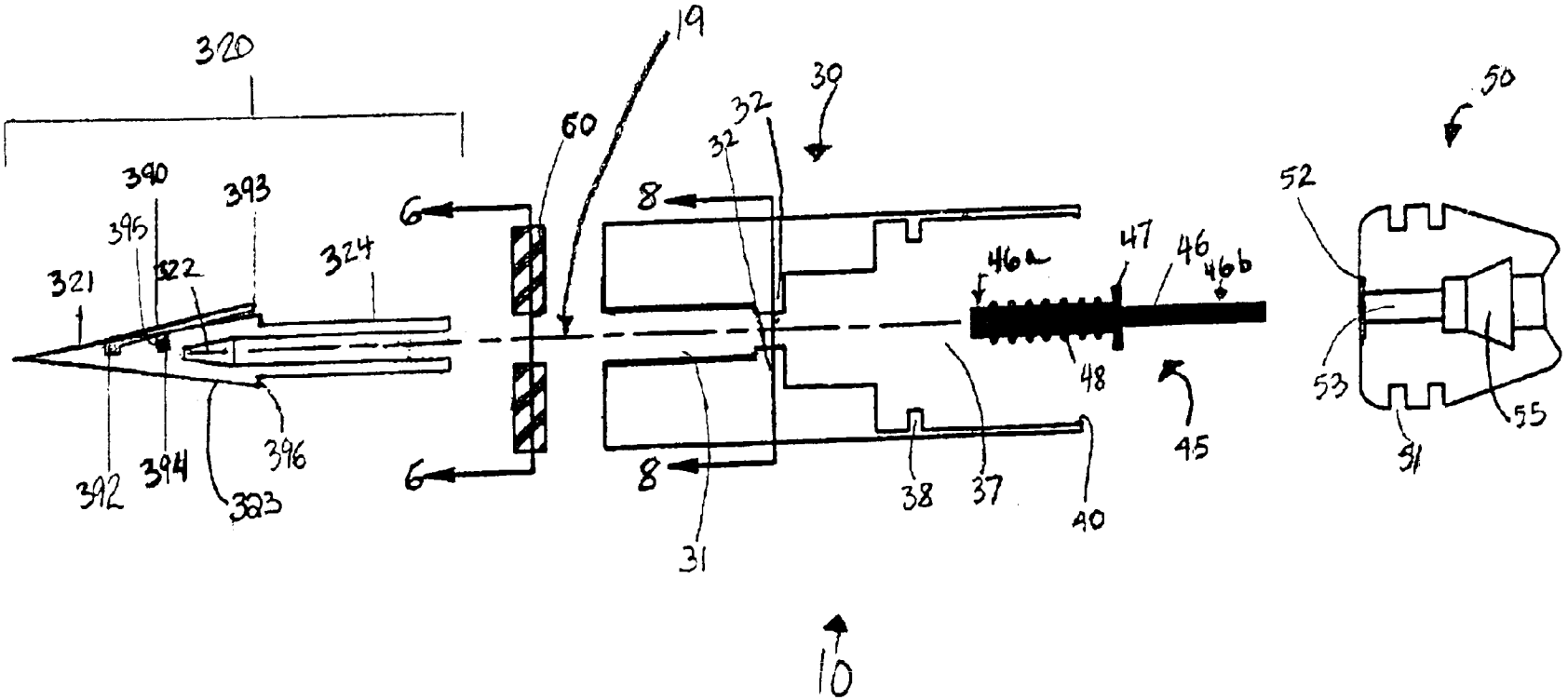
FIG. 5 is a cross-sectional exploded view of another embodiment of the device shown in FIG. 3 in which the punch includes a spring-loaded arm.

FIG. 5 shows a punch 320 having a tip 321, one or more apertures 322, an angled shaft portion 323, a shoulder 396 defining the back edge of the angled shaft portion, a cylindrical shaft portion 324, and a spring-loaded arm 390. Arm 390 is attached at 392 to the angled shaft portion 323 towards the tip and extends back to the shoulder. The arm 390 is biased away from the angled shaft portion 323 such that the back end 393 of the arm 390 moves outward from the angled shaft portion 323. The bias can be provided by a spring 394 positioned in recess 395. Further, the bias could be provided by the flexibility of the arm 390 itself, such that the arm 390 snaps back to an initial position after being pressed against the shaft portion 323. Such an arrangement would obviate the need for a spring.

Central body 30 of the device is generally cylindrical and includes a lower receptacle 31 for engaging punch 20, and an upper receptacle 37. Central body 30 is preferably made of rigid plastic, resin, or other suitable material. Cylindrical shaft portion 24 of punch 20 may be permanently affixed to the interior of central body 30, for example, by glue or other adhesive or attachment means, or it may be formed integrally therewith. The diameter of lower receptacle 31 is sized to securely receive cylindrical shaft portion 24 of punch 20.

Figure 6:
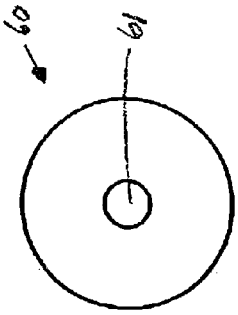
FIG. 6 is a cross-sectional view of a gasket of the device taken along line 6—6 of FIG. 2.
Figure 10:
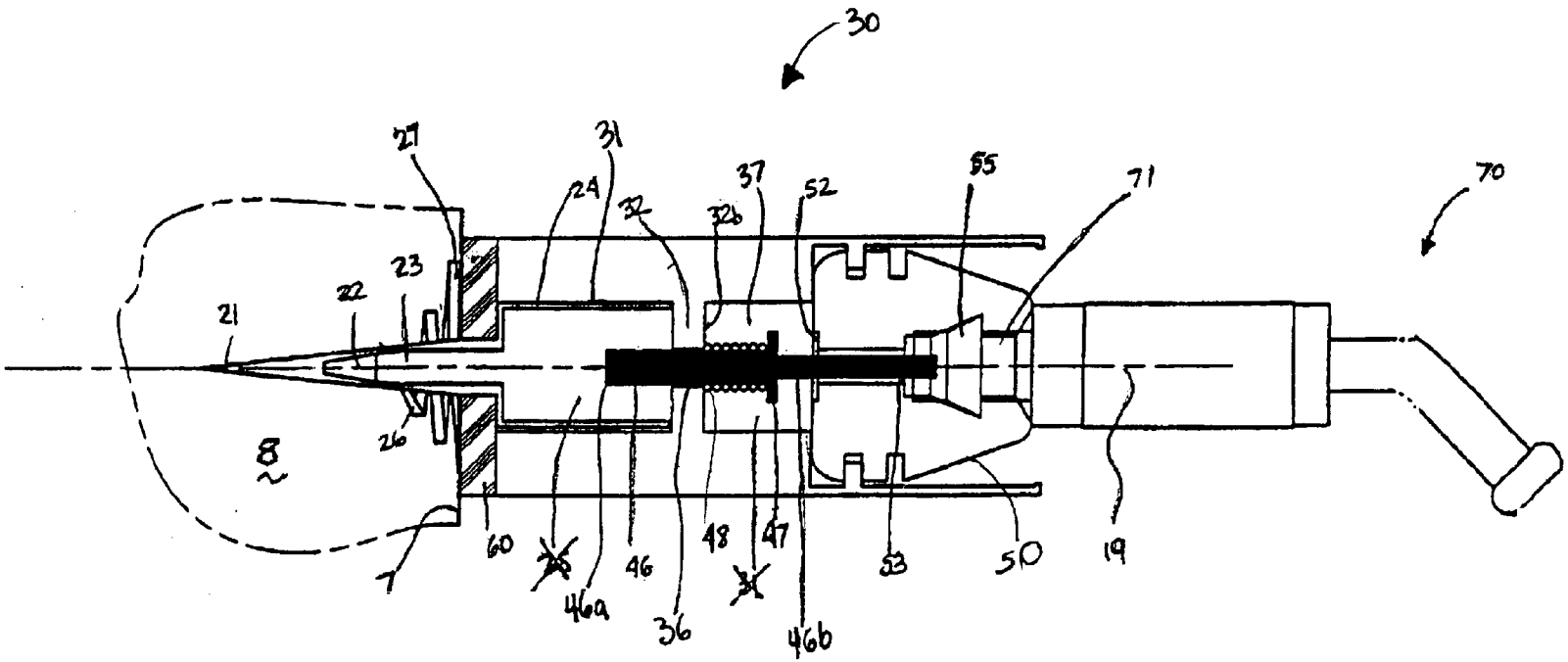
FIG. 10 is a cross-sectional view of the device shown in FIG. 9 connected at one end to a drinking fluid container and connected at the other end to a protective mask drinking tube.

A gasket 60 is provided between punch 20 and central body 30. As shown in FIG. 6, gasket 60 has a central aperture 61 for positioning over cylindrical shaft portion 24, 124, 224, or 324. Gasket 60 may be made of a rubber, polymeric, or other similar compressible material. When the device of the invention is inserted into a fluid container, the container wall is held between a terminal portion of the punch and the gasket. For example, terminal thread portion 27 of punch 20, or, likewise, terminal flange 282 of punch 220, or shoulder 396 and arm end 393 of punch 320, engages the interior wall 7 of fluid container 8 (as shown in FIG. 10), and gasket 60 bears against the exterior wall of container 8, to provide a seal resistant to leakage and contamination. Gasket 60 may be permanently secured to the central body 30 using adhesive or the like.

Figure 7:
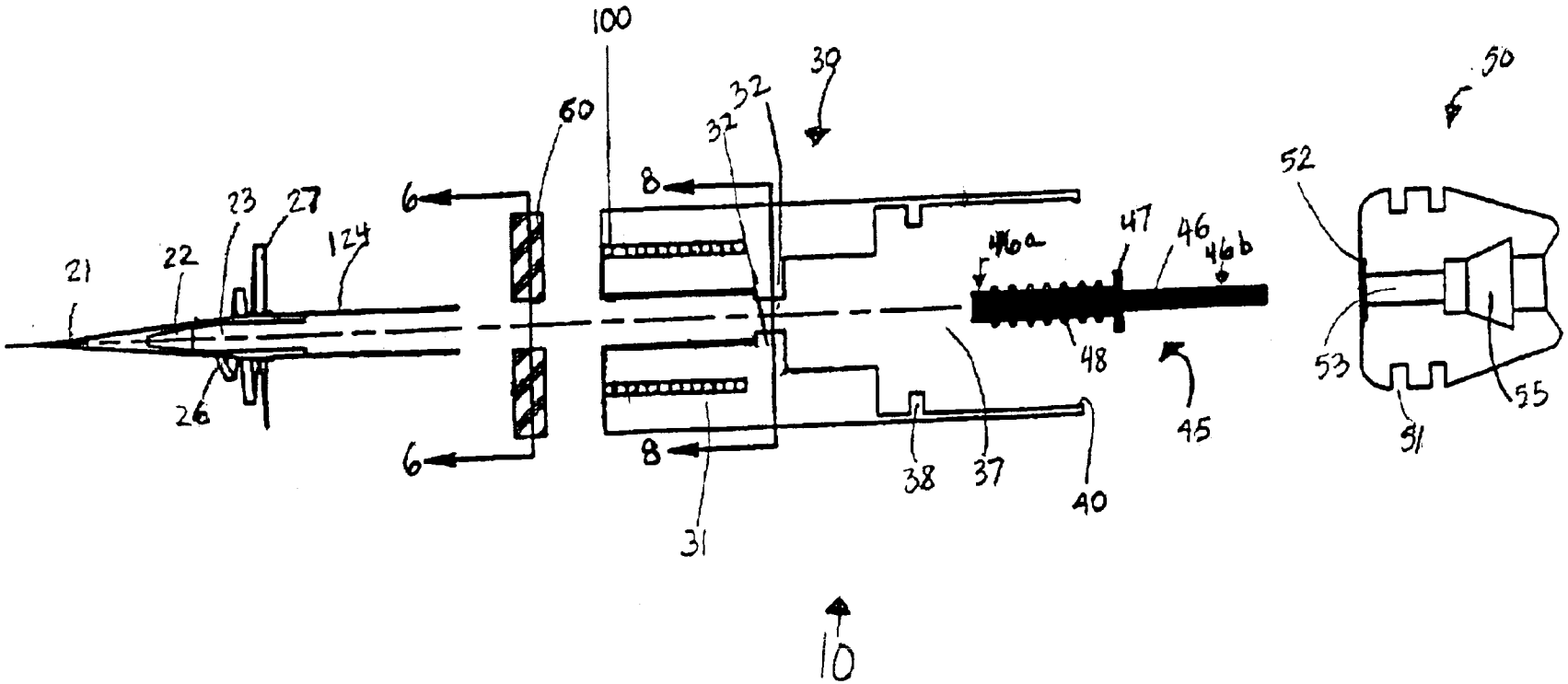
FIG. 7 is a cross-sectional exploded view of another embodiment of the device shown in FIG. 3 wherein the gasket is biased against a container wall.

Gasket 60 could be biased away from the central body, and against a container wall, by one or more springs contained within the central body 30. As shown in FIG. 7, spring 100 is positioned in an annular recess, preferably within the periphery of the central body adjacent lower receptacle 31. Spring 100 bears against gasket 60 to bias the gasket 60 against the container wall.

A valve 45 is disposed within central body 30 to control the flow of fluid through the device. Valve 45 has a cylindrical shaft 46 and an annular flange 47. Shaft 46 has a lower shaft portion 46*a* and upper shaft portion 46*b*. Spring 48 is inserted onto lower shaft portion 46*a* adjacent to annular flange 47 to bias shaft 46 in a first, closed position wherein flange 47 is seated in seat 52 at the edge of port 50.

Figure 8:
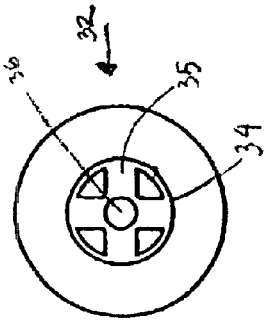
FIG. 8 is a cross-sectional view of an annular projection within the device taken along line 8—8 of FIG. 2.

Shaft 46 of valve 45 is maintained in an orientation along the longitudinal axis 19 by an annular projection 32 within central body 30. Annular projection 32 separates upper receptacle 37 and lower receptacle 31 of central body 30. As shown in FIG. 8, annular projection 32 includes an inner ring 34 having a central aperture 36 and spokes 35. Shaft 46 extends through central aperture 36 of annular projection 32. Fluid can flow through openings between spokes 35 from lower receptacle 31 of central body 30 and into upper receptacle 37.

A port 50 allows a mask drinking tube to be removably connected with the coupling device 10. Port 50 is preferably constructed of firm, compressible rubber or other suitable material generally in the shape of a cylinder. Port 50 is positioned within upper receptacle 37 of central body 30. Port 50 may include exterior grooves 51, an inner bore 53, and a seat 52 centrally located at a first end of inner bore 53. Exterior grooves 51 engage one or more annular ribs 38 on the inner wall of upper receptacle 37 to secure port 50 within central body 30. A lip 40 on the open end of upper receptacle 37 further engages port 50 to retain the port within central body 30. Other configurations of the port, and its attachment to the central body, are considered within the scope of the invention. Port 50 includes a compressible female receptacle 55 at the second end of inner bore 53 sized and shaped to receive a rigid male connector on the mask drinking tube, and to retain the male connector therein. The receptacle could include a shoulder to retain the male connector in position. The male connector can be removed by pulling it from the female receptacle with sufficient force.

Figure 9:
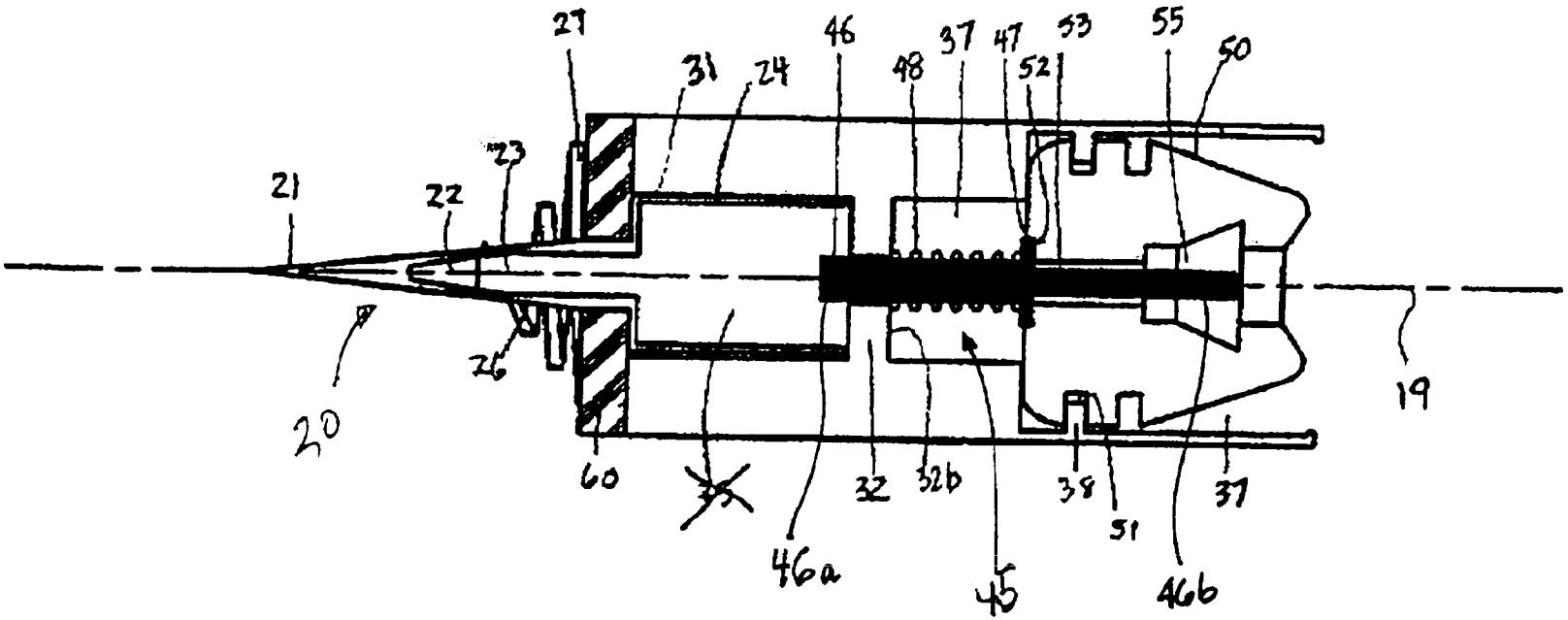
FIG. 9 is a cross-sectional view of the device shown in FIGS. 1 and 2 in an assembled form.

FIGS. 9 and 10 show the assembled components of the device of the invention. Referring to FIG. 9, cylindrical shaft portion 24 of punch 20 is inserted in lower receptacle 31 of central body 30. Gasket 60 is seated between the bottom end of lower receptacle 31 of central body 30 and terminal thread portion 27 of threaded shaft 23.

Valve 45 extends from upper receptacle 37 to lower receptacle 31 of central body 30. Lower portion 46*a* of shaft 46 extends through central aperture 36 of annular projection 32. Spring 48 is positioned against upper side 32*b* of annular projection 32. The upper shaft portion 46*b* extends into inner bore 53 of port 50. Annular flange 47 of valve 45 is seated in seat 52 at the first end of inner bore 53 of port 50.

FIG. 10 shows the coupling device of the present invention inserted into a fluid container 8. As threaded shaft portion 23 is rotated, the thread rides into the drinking fluid container. Initial thread portion 26 is open-angled to catch the wall of container 8. Terminal thread portion 27 is generally perpendicular to the longitudinal axis 19 of the device and enters container 8 and engages or entraps the punch within the container by sitting against interior wall 7 of container 8.

Similarly, with reference to the ridged punch configuration described above and shown in FIG. 4, cylindrical shaft portion 224 of punch 220 is inserted in lower receptacle 31 of central body 30. Gasket 60 is seated between the bottom end of lower receptacle 31 of central body 30 and terminal ridge 282 on shaft 223. As the ridged punch is inserted into the drinking fluid container 8, the terminal ridge 282 enters container 8 and the trailing edge thereof engages or entraps the punch within the container by sitting against interior wall 7 of container 8.

Likewise, with reference to the spring-loaded arm punch configuration described above and shown in FIG. 5, cylindrical shaft portion 324 of punch 320 is inserted in lower receptacle 31 of central body 30. Gasket 60 is seated between the bottom end of lower receptacle 31 of central body 30 and shoulder 396 and the back end 393 of arm 390. As the punch is inserted into the drinking fluid container, arm 390 is retained against angled shaft 323 by the force of the container wall bearing on the arm. Once inside the container, arm 390 is urged away from the angled shaft, along with shoulder 396 engages or entraps the punch within the container by sitting against interior wall 7 of container 8.

After punch 20 is inserted into fluid container 8, fluid from container 8 enters the device through apertures 22, flows into cylindrical shaft portion 24 which is positioned within lower receptacle 31, and flows through the openings between spokes 35 in annular projection 32 into upper receptacle 37. The male connector 71 of mask tube 70 is inserted into female receptacle 55 at the second end of the inner bore 53 of port 50. The male connector 71 pushes valve 45 against its bias in the direction of the fluid container, unseating annular flange 47 from seat 52. Fluid contained in upper receptacle 37 can then flow into the first end of the inner bore 53 of port 50 through the connection between the male connector 71 and female receptacle 55 and into mask drinking tube 70 which is connected to a mouth inlet of the protective mask.

The device of the invention may further include a fitted cap placed over the top of the open end of upper receptacle 37 of central body 30 to secure port 50 in the central body. The cap would have an aperture to provide access for mask drinking tube 70 to port 50. The device could further include a protective covering placed over the cap to cover the access port until the device is used. The device could also include a protective covering over the entire device to protect it from contamination before use. Such protective covering should be strong to resist inadvertent tearing, yet be capable of being torn open by hand, for example, along a scored line. An example of such a covering is plastic wrapping.

Figure 11:
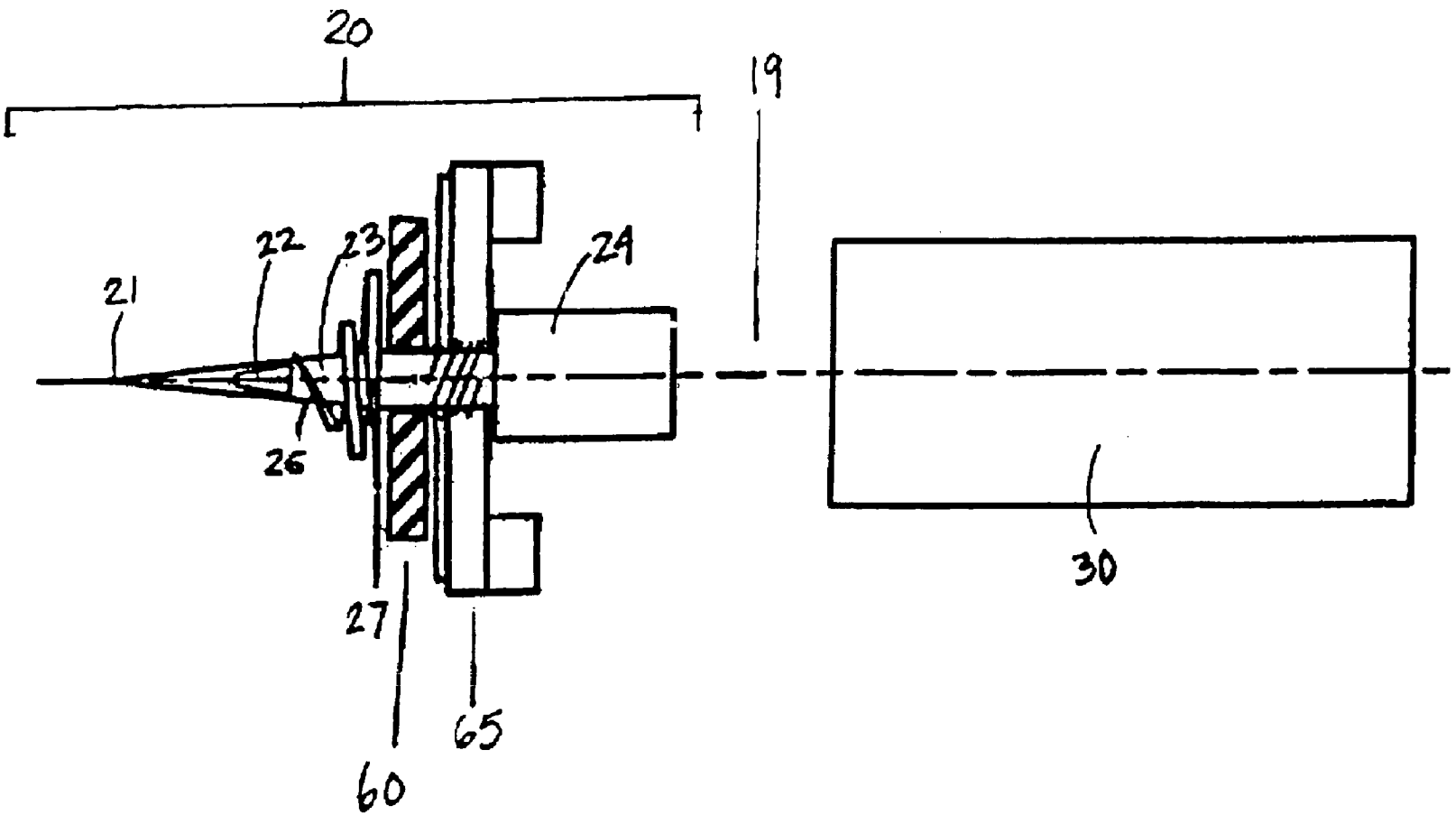
FIG. 11 is a cross-sectional view of another embodiment of the device shown in FIG. 1 having a locking nut for urging the gasket against a wall of a drinking fluid container.
Figure 1:
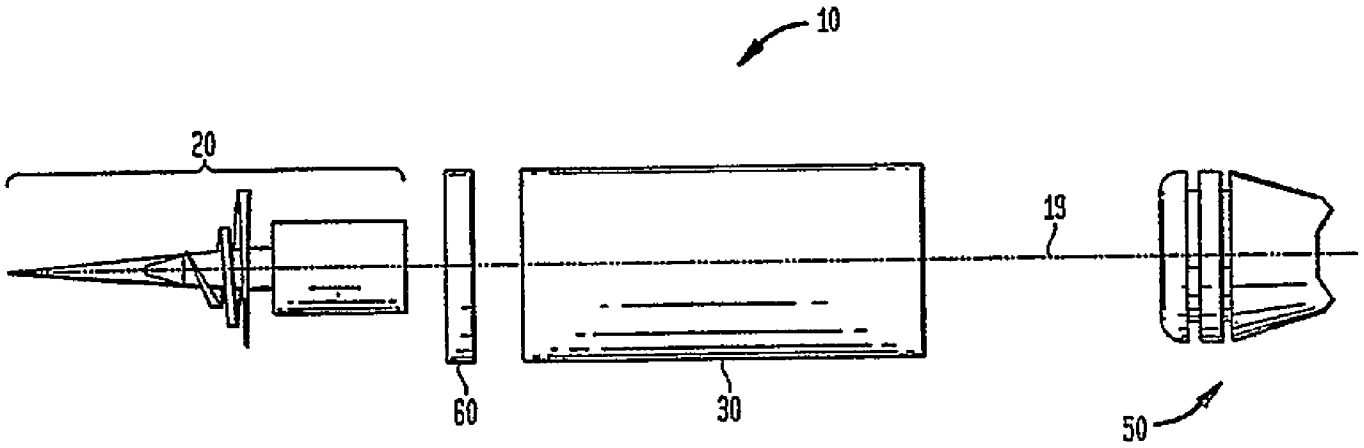
Figure 2:
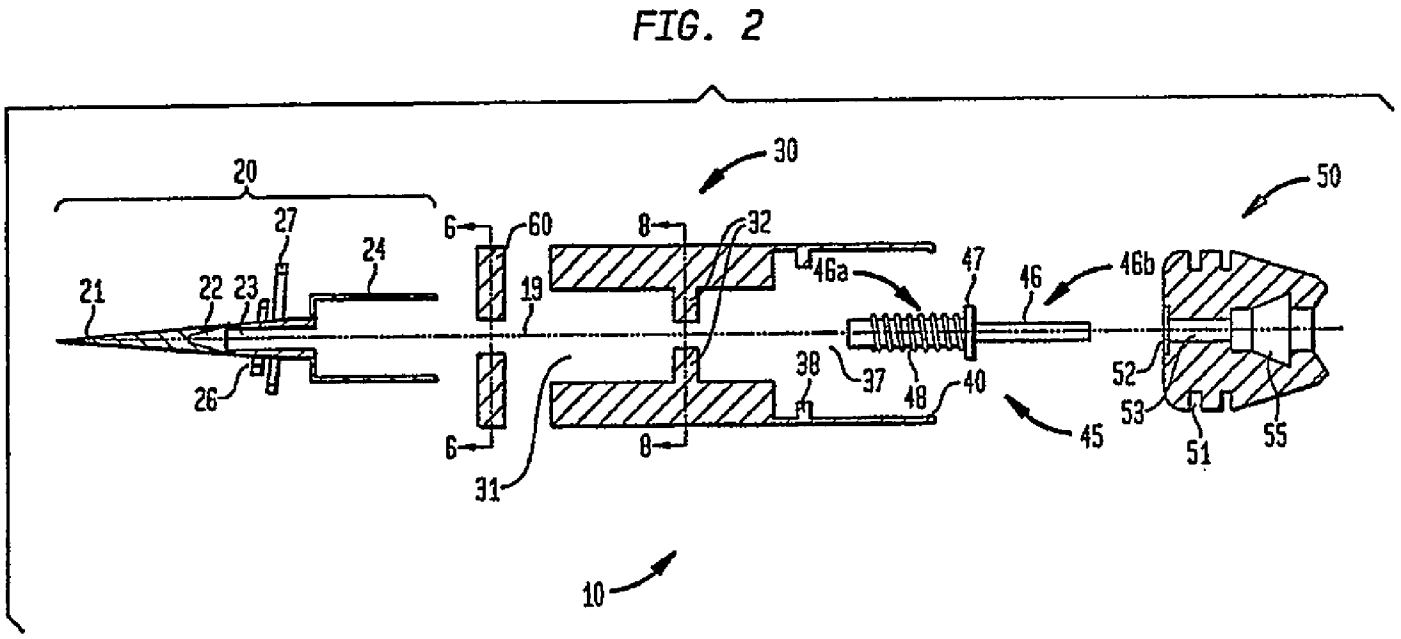
Figure 3:
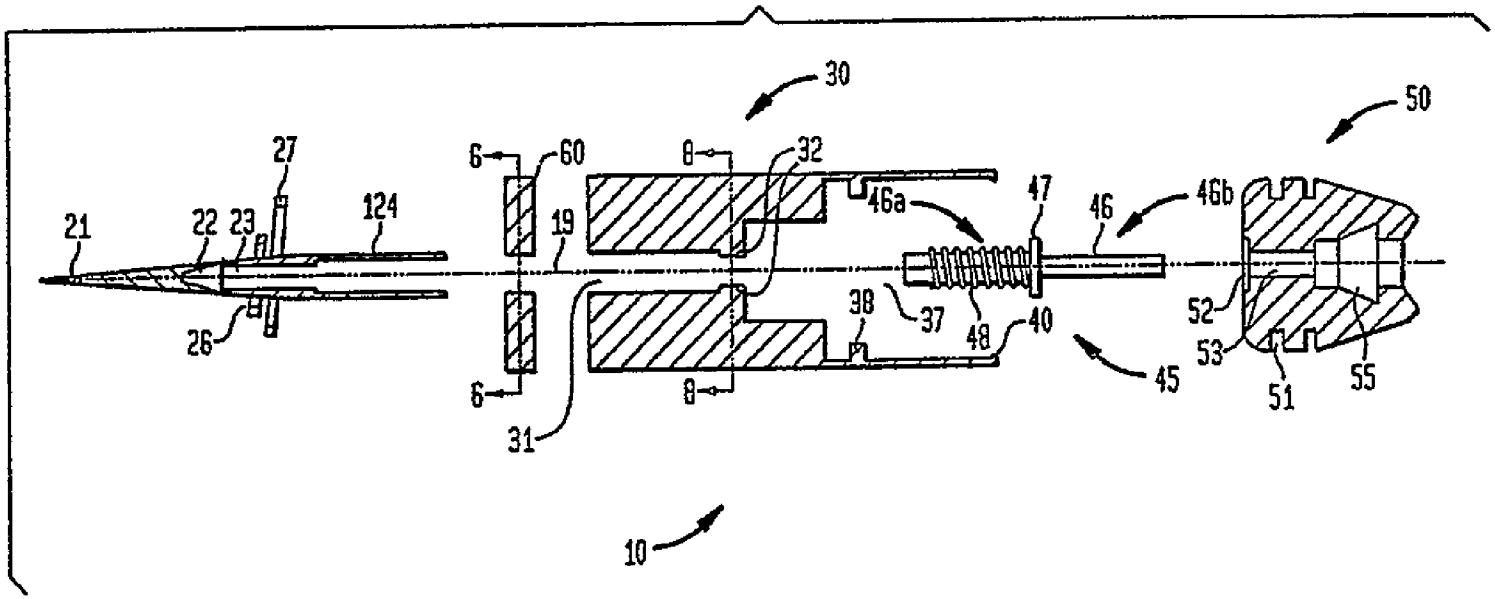
Figure 4:
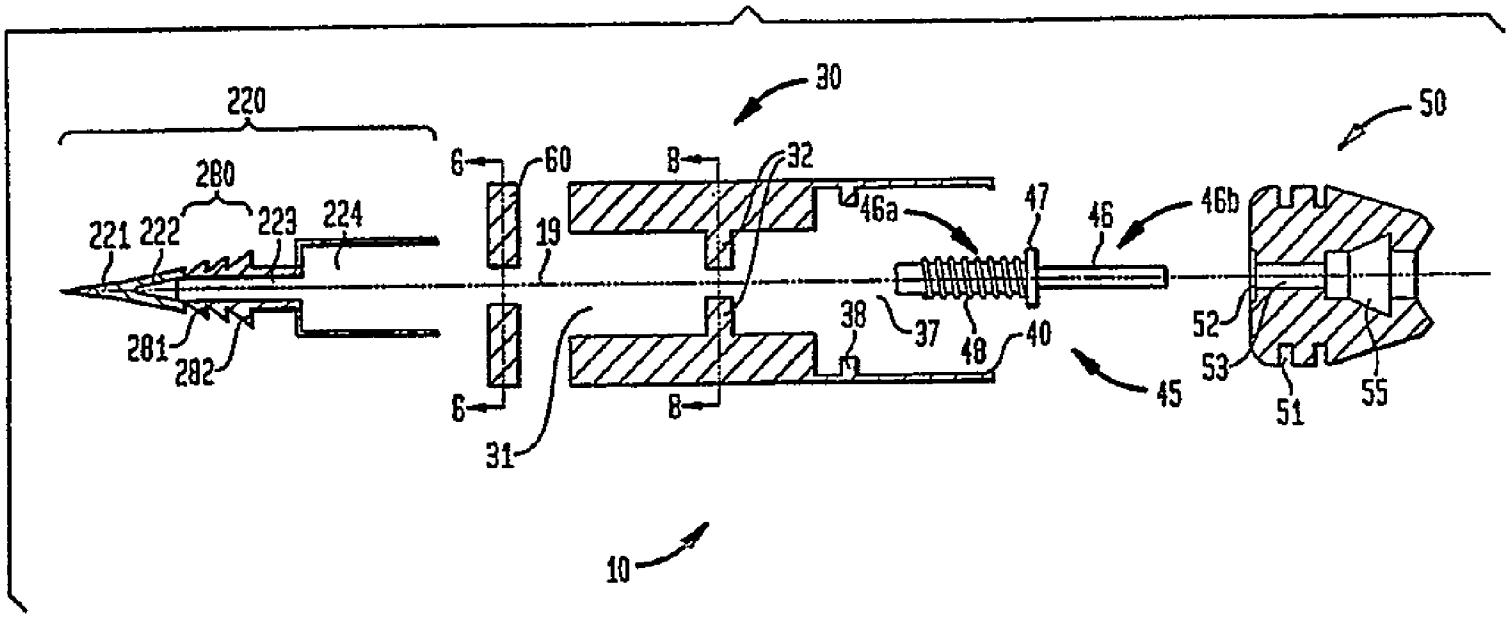
Figure 5:
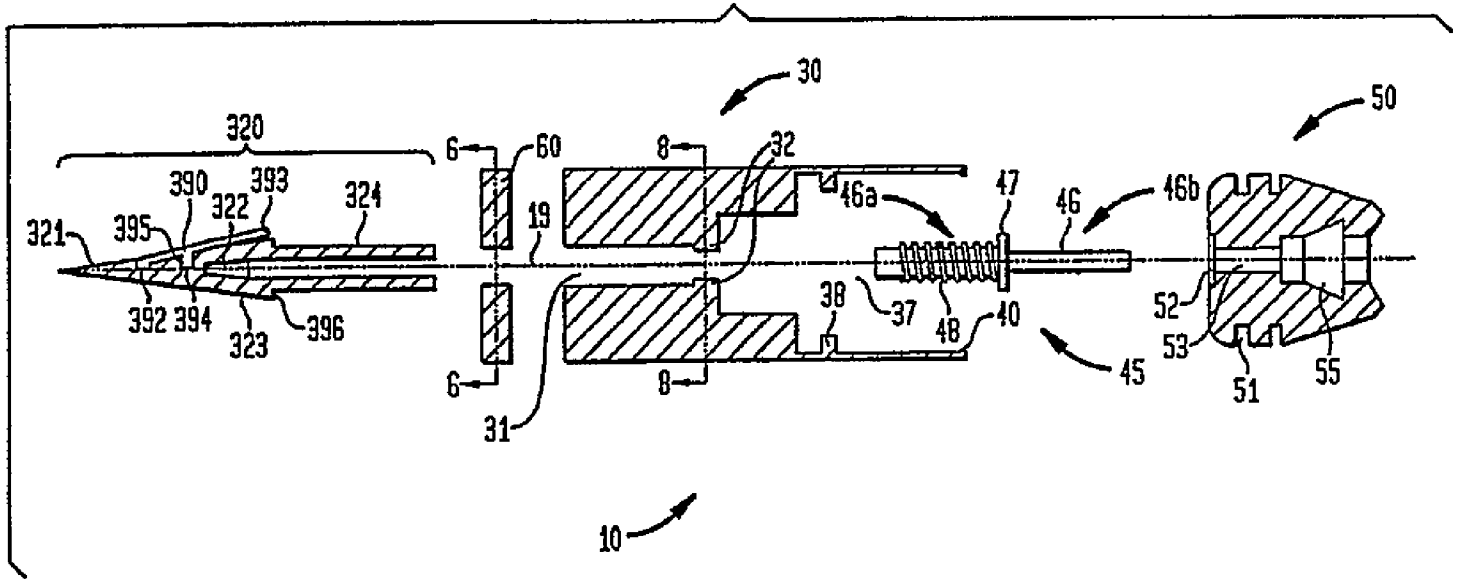
Figure 7:
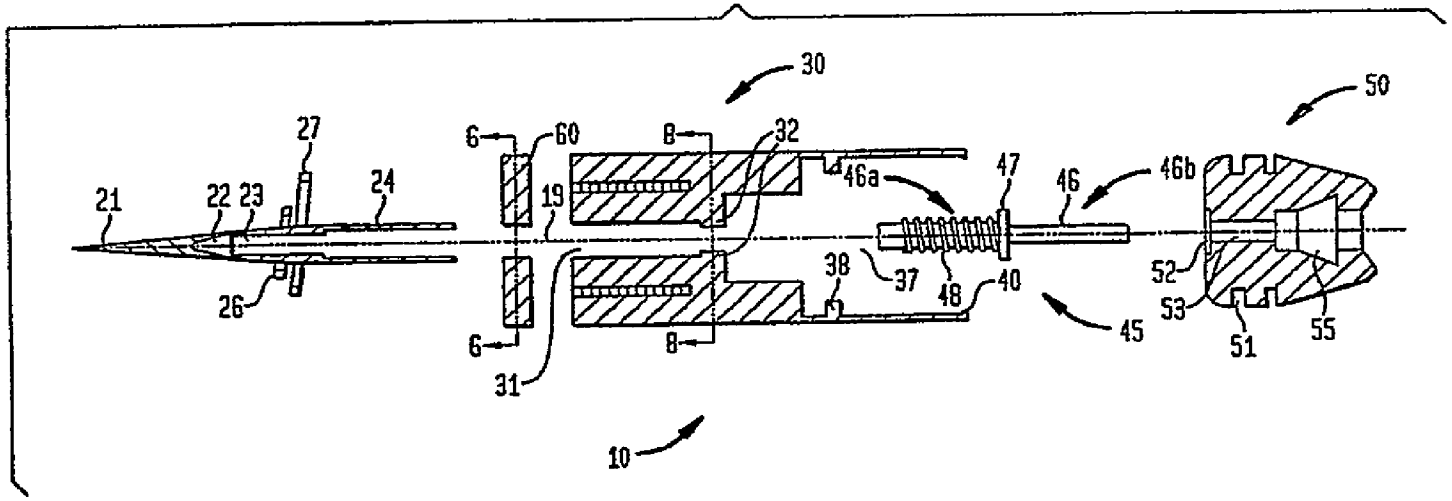
Figure 8:
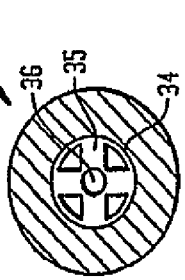
Figure 6:
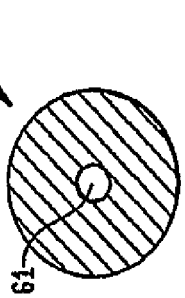
Figure 9:
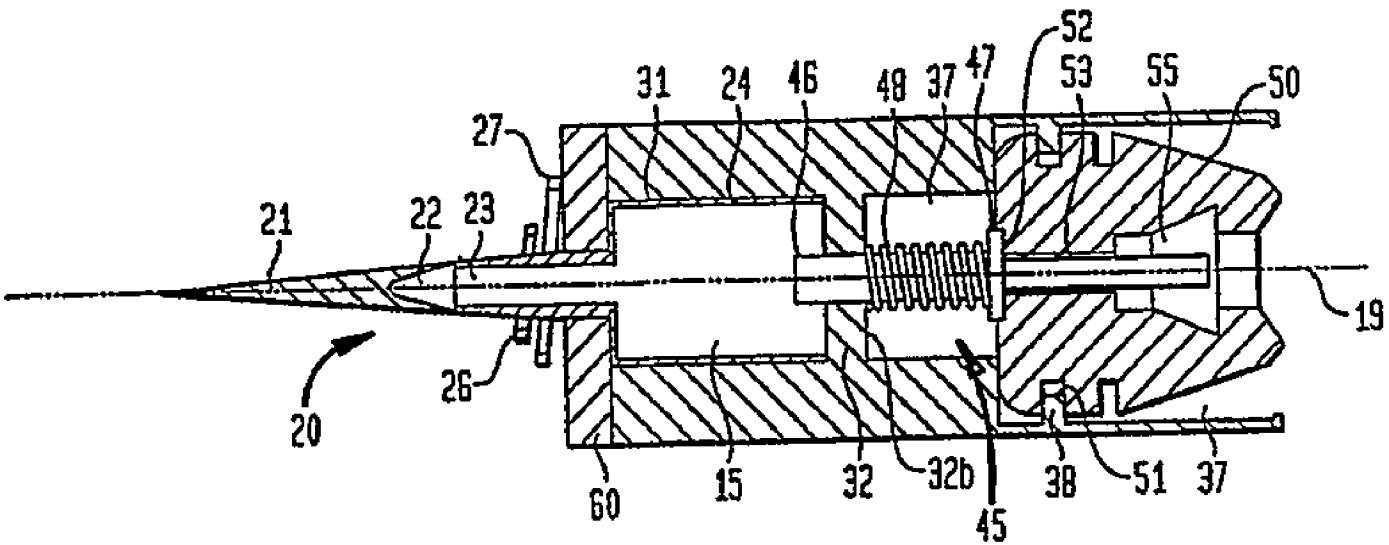
Figure 10:
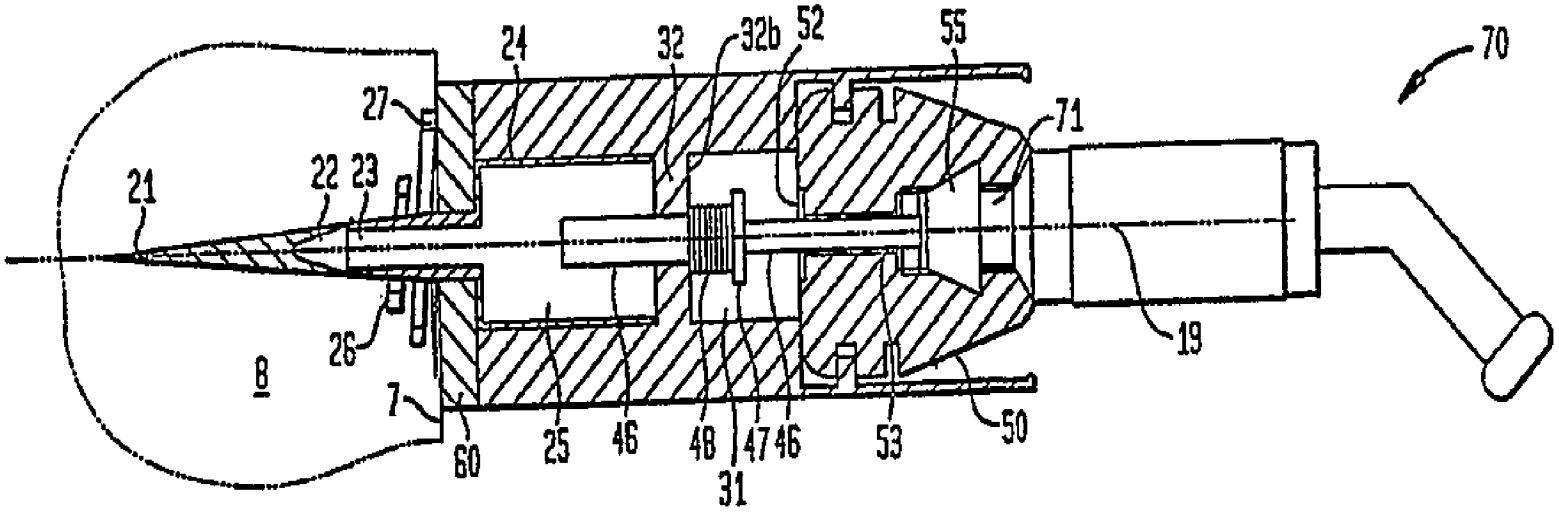
Figure 11:
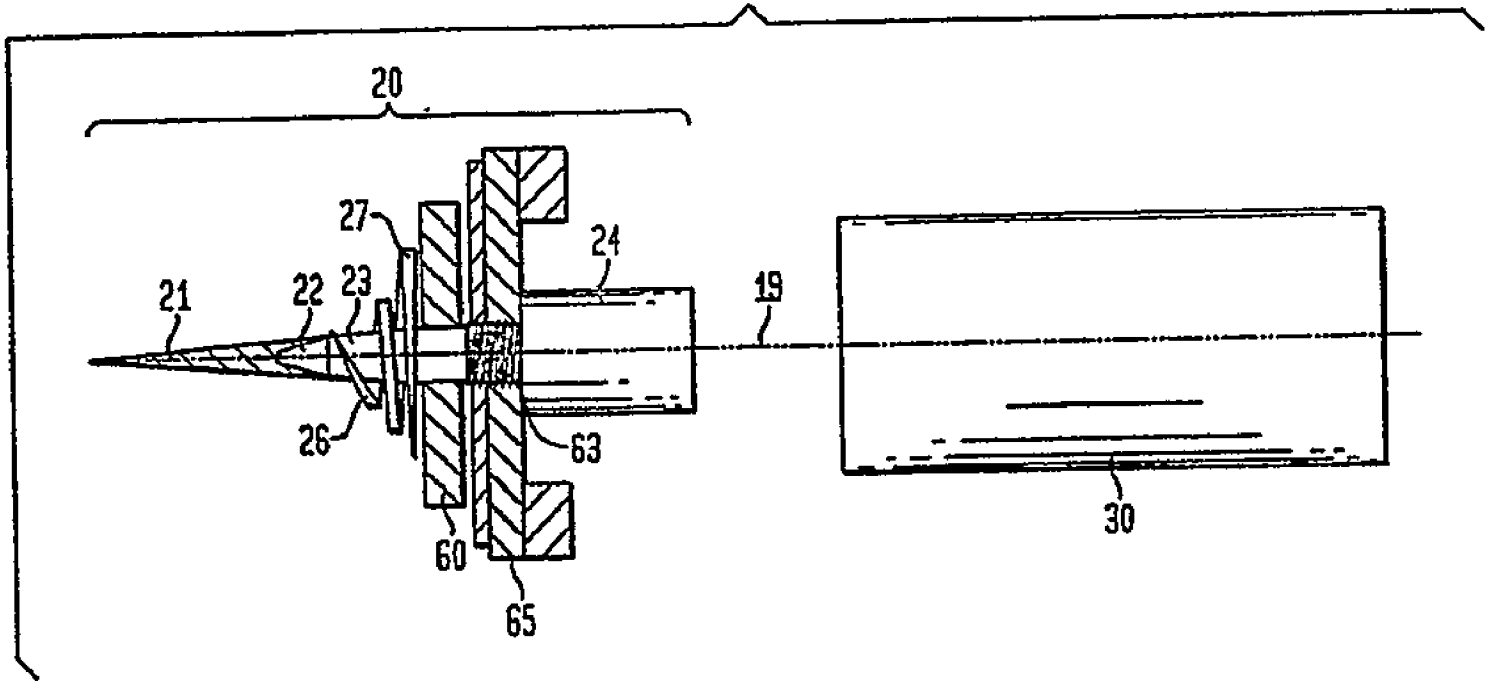

FIG. 11 shows another embodiment of the invention which includes a nut 65 for further tightening and securing the device to a wall of the fluid container. The nut 65 could be a locking wheel, winged nut, or the like which can be threaded down to compress the gasket 60 against the side wall of the fluid container. The nut engages a second set of threads 63 on the shaft 23 of punch 20. Similarly, for the alternate embodiments shown in FIGS. 3, 4 and 5, the nut could engage a second set of threads on shaft 124, 223 or 324, respectively.

The device of the present invention can be used as follows:

1. A drinking fluid in a standard container, such as water in a plastic water bottle, is obtained.
2. The container wall is checked for contamination with a commercially available detection device, e.g., military issued M8 detector paper.
3. If contaminated, the exterior of the container, or a portion thereof, is decontaminated using a commercially available decontamination kit, e.g., >5% dilute chlorine bleach solution or a military issued M258A1 decontamination set.
4. The drinking coupling device is removed from a protective covering or wrapper if present.
5. The wall of the container is punctured with the tip of the punch of the drinking coupling device.
6. The punch is engaged with the container by threading a threaded shaft portion though the wall of the container, or by applying force to engage a terminal ridge with the wall of the container, or by applying force to engage a spring-loaded arm with the container, or otherwise engaging the punch with the container, a gasket of the punch, if present, bearing against the exterior of the container wall.
7. A locking wheel, if present, is screwed down to urge the gasket against the wall of the container.
8. A protective covering, if present, is removed from the access port of the coupling device cap.
9. The male connector of the drinking tube from the M-series protective mask is pushed into the female receptacle of the port of the drinking coupling device.

10. Air is blown into the container to create positive pressure.
11. Several swallows of fluid are taken from the container by raising and inverting the container.
12. Pressure in the container is equalized after several swallows by a) removing the tube from the mouth, b) lowering the container, and c) blowing air into the mask tube and into the container to prevent the container from collapsing.
13. The drinking procedure is repeated as required.
14. After drinking is completed, the container with the drinking coupling device attached is discarded, and the drinking tube is replaced in the M-series Protective Mask.

Having thus described the invention in detail, it is to be understood that the foregoing description is not intended to limit the spirit and scope thereof. What is desired to be protected by Letters Patent is set forth in the appended claims.

What is claimed is:

1. A device for coupling a drinking tube of a protective mask to a drinking fluid container comprising:

a punch for piercing a wall of the fluid container, the punch having an aperture for fluid to flow therein;

a central body in fluid communication at a first end with the punch;

a port disposed at the second end of the central body, the port having an inner bore in fluid communication with the central body, the inner bore having a female receptacle for receiving a male connector of the drinking tube; and a valve disposed in the central body for controlling fluid flow through the central body, wherein the valve is biased to a first, closed position wherein a flange is seated at an end of the port, and the valve is moved to a second open position by the male connector of the drinking tube when the male connector is inserted into the female receptacle;

wherein the aperture in the punch, the central body, and the inner bore of the port form a flow path through which the fluid from the container flows to a drinking tube.

2. The device of claim 1 further comprising a thread on the punch for threading the punch into the wall of the fluid container.

3. The device of claim 2, wherein the thread on the punch increases in diameter from an initial thread to a terminal thread.

4. The device of claim 3, wherein the terminal thread on the punch is generally perpendicular to the longitudinal axis of the punch.

5. The device of claim 3, further comprising a gasket between the terminal thread on the punch and the first end of the central body.

6. The device of claim 1, further comprising a gasket between the punch and the first end of the central body.

* * * * *

UNITED STATES PATENT AND TRADEMARK OFFICE

CERTIFICATE OF CORRECTION

PATENT NO. : 6,932,239 B2
APPLICATION NO. : 10/364296
DATED : August 23, 2005
INVENTOR(S) : Robert McKittrick It is certified that error appears in the above-identified patent and that said Letters Patent is hereby corrected as shown below:

On the Title Page, Item (76), inventor's last name should read --McKittrick--

The Title Page, showing an illustrative figure, should be deleted and substitute therefor the attach tile page.

Delete drawings sheets 1-9 and substitute therefor the drawing sheets, consisting of figs. 1-11 as shown on the attached page.

Signed and Sealed this

Sixth Day of March, 2007

JON W. DUDAS
*Director of the United States Patent and Trademark Office*

(12) United States Patent
McKitrick

(10) Patent No.: US 6,932,239 B2
(45) Date of Patent: Aug. 23, 2005

(54) PROTECTIVE MASK DRINKING TUBE COUPLING DEVICE AND METHOD OF USE

(76) Inventor: Robert McKitrick, 152 Wunnegin Cir., East Greenwich, RI (US) 02818

( * ) Notice: Subject to any disclaimer, the term of this patent is extended or adjusted under 35 U.S.C. 154(b) by 78 days.

(21) Appl. No.: 10/364,296

(22) Filed: Feb. 11, 2003

(65) Prior Publication Data

US 2004/0155054 A1 Aug. 12, 2004

(51) Int. Cl.[7] ..... B67D 5/00

(52) U.S. Cl. ..... 222/83; 222/91; 220/705; 220/714; 215/388

(58) Field of Search ..... 222/80–83, 86, 222/91, 175, 207, 464.1; 128/202.15, 202.16, 206.29; 220/705, 709, 714, 717, 707; 215/388, 11.4; 239/33

(56) References Cited

U.S. PATENT DOCUMENTS

| | | | | |
|---|---|---|---|---|
| 1,618,720 A | * | 2/1927 | Moore | 222/91 |
| 1,645,127 A | | 10/1927 | Carnes | |
| 3,278,083 A | * | 10/1966 | Serafini | 222/91 |
| 3,731,717 A | | 5/1973 | Potash | 141/379 |
| 3,768,698 A | * | 10/1973 | Corty et al. | 222/91 |
| 3,973,698 A | * | 8/1976 | Kato | 222/91 |
| 4,398,533 A | * | 8/1983 | Barker | 128/202.15 |
| 4,505,310 A | | 3/1985 | Schneider | 141/114 |
| 4,712,594 A | | 12/1987 | Schneider | 141/114 |
| 4,826,500 A | | 5/1989 | Rautsola | 604/411 |
| 4,875,508 A | | 10/1989 | Burke, II et al. | 141/2 |
| 4,881,662 A | * | 11/1989 | Tallman | 222/81 |
| 4,971,048 A | | 11/1990 | Seekins | 128/202.15 |
| 5,090,596 A | | 2/1992 | Knight | 222/91 |
| 5,146,757 A | | 9/1992 | Dearing | 62/61 |
| 5,328,059 A | | 7/1994 | Campbell | 222/189 |
| 5,609,582 A | | 3/1997 | Krotten | 604/247 |
| 5,971,207 A | | 10/1999 | McDonough et al. | 222/1 |
| 6,202,717 B1 | | 3/2001 | Markey et al. | 141/383 |
| 6,325,116 B1 | | 12/2001 | Savage et al. | 141/349 |
| 2002/0092858 A1 | | 7/2002 | Bowman | 220/709 |
| 2002/0121525 A1 | | 9/2002 | Stillinger et al. | 220/705 |

OTHER PUBLICATIONS

"Protect Yourself From NBC Injury/Contamination When Drinking From Your Canteen While Wearing Your Protective Mask," Soldier's Manual of Common Tasks, Skill Level 1, Soldier Training Publication No. 21–2– SMCT, Department of the Army, Washington, DC, pages i and 320–331, 1994.

* cited by examiner

*Primary Examiner*—Frederick Nicolas
(74) *Attorney, Agent, or Firm*—McCarter & English, LLP

(57) ABSTRACT

A coupling device is provided for allowing one wearing a protective mask to drink fluids from a standard drinking fluid container. The device includes a punch at one end, a central body, and a capture port at the other end of the central body. The punch punctures a wall of a fluid container. Drinking fluid flows into the central body. The drinking tube is inserted into the port to allow one to drink fluid from the container. The device allows one wearing a protective suit in a contaminated environment to obtain drinking fluid from a standard, commercially-available container.

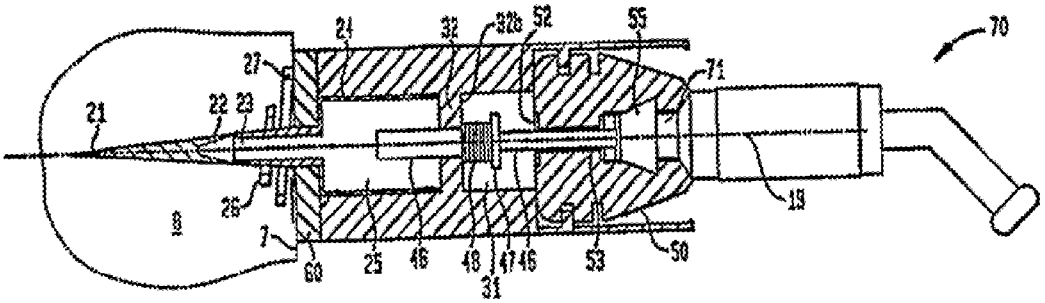

6 Claims, 9 Drawing Sheets